United States Patent [19]

Schneider

[11] Patent Number: 4,919,208

[45] Date of Patent: Apr. 24, 1990

[54] METHOD AND APPARATUS FOR MANIPULATING TUBING IN A WELL

[76] Inventor: Chris K. Schneider, P.O. Box 2214, Matthews, N.C. 28106

[21] Appl. No.: 96,127

[22] Filed: Sep. 11, 1987

[51] Int. Cl.[5] ..... E21B 33/14

[52] U.S. Cl. ..... 166/286; 166/177; 166/241; 166/242; 166/384

[58] Field of Search ..... 166/286, 285, 380, 381, 166/177, 241, 242, 249, 384, 65.1, 173; 175/325, 73, 75, 76

[56] References Cited

U.S. PATENT DOCUMENTS

| | | | |
|---|---|---|---|
| 1,767,198 | 6/1930 | Baker | 166/241 |
| 2,309,791 | 2/1943 | Sanders | 166/285 |
| 2,602,512 | 7/1952 | Baker | 166/241 |
| 2,734,720 | 2/1956 | Zublin | 175/76 |
| 2,812,200 | 11/1957 | Yeargan | 166/173 X |
| 2,829,190 | 4/1958 | Comlossy, Jr. | 166/65.1 X |
| 2,841,366 | 7/1958 | Dunn | 175/320 X |
| 3,363,688 | 1/1968 | Bielstein | 166/285 |
| 3,557,875 | 1/1971 | Solum et al. | 166/286 |
| 4,312,405 | 1/1982 | Wilder | 16/285 |
| 4,319,649 | 3/1982 | Jeter | 175/73 |
| 4,416,339 | 11/1983 | Baker et al. | 175/73 X |
| 4,603,737 | 8/1986 | Spikes | 166/65.1 X |

FOREIGN PATENT DOCUMENTS

| | | | |
|---|---|---|---|
| 2544375 | 10/1984 | France | 175/325 |
| 467170 | 7/1975 | U.S.S.R. | 166/241 |
| 588347 | 1/1978 | U.S.S.R. | 166/241 |
| 1266956 | 10/1986 | U.S.S.R. | 166/241 |
| 2083102 | 3/1982 | United Kingdom | 175/325 |
| 2138056 | 10/1984 | United Kingdom | 166/241 |

OTHER PUBLICATIONS

"World Oil's Cementing Oil and Gas Wells", Suman et al, Word Oil, 1977, pp. 32–37.

*Primary Examiner*—Hoang C. Dang

[57] ABSTRACT

A method and apparatus are disclosed which enable one to manipulate a tubular string within a wellbore or the like to cause the area of largest standoff between the tubing and the wellbore to be moved radially at least part way around the circumference of the wellbore without the need for any axial movement of the tubular string or any device attached thereto. The method and apparatus are particularly useful for obtaining circumferentially complete distribution of cement around a tubular string in a wellbore.

16 Claims, 5 Drawing Sheets

METHOD AND APPARATUS FOR MANIPULATING TUBING IN A WELL

FIELD OF THE INVENTION

This invention relates to a method and apparatus for manipulating a tubing string in a wellbore. In particular this invention is concerned with a method and apparatus for use in some situations in which it is desired to shift a tubular string within a wellbore such that the area of largest standoff between the tubing and the well bore wall is moved radially around the circumference of the wellbore.

BACKGROUND OF THE INVENTION

In the drilling of wells, particularly for oil and gas, holes are drilled deep into the earth and tubular strings of pipe are inserted within the resulting wellbore. One typical operation of this type involves inserting a tubular string of casing in the well and cementing the casing in the wellbore. That operation involves forcing cement grout into the annulus between the wall of the wellbore and the casing. The objective in such a cementing operation is to obtain a circumferentially continuous distribution of the cement in the annulus so that when the cement sets up it will preclude formation or producing fluids from migrating vertically between the casing and the wellbore wall. Due to the fact that the casing is generally never totally centered within the wellbore there are areas within the wellbore in which the cement often cannot flow in a uniform manner. This often leads to incomplete surrounding of the casing with cement which in turn leads to undesirable leakage of formation or producing fluids.

When a tubular string is rotated in a conventional manner every point aroung the circumference of the tubular string is in the large standoff area for a time. This improves the cement bond to the tubular string but does not improve the cement bonding to the well bore.

In the past one of the techniques used to try to insure that cement is applied in a circumferentially continuous manner around the casing has been to rotate the casing while moving it up and down axially within the wellbore as the cement is being pumped into the annulus. World Oil, "Cementing Oil and Gas Wells", pages 32–37 by G.O. Suman, Jr and R.C. Ellis (1972) discloses the use of rotation or rotation and reciprocation to provide additional displacement forces which aid in distributing the cement.

The reciprocation of casing is not, however, universally practiced due to the risk that the casing may become stuck above the desired location depth. Further that technique is often resisted because of the risk that the casing string may be broken.

U.S. Pat. No. 4,312,405 discloses a variation of the technique in which a stab-in string within the tubular casing string is attached to the lower end of the tubular casing string and is reciprocated while the top of the tubular casing string is maintained at stationary level. The patent states that when the inner pipe is moved axially in that manner it causes buckling of the lower end of the casing to change the standoff of the casing.

An object of the present invention is to provide method and apparatus useful for causing the area of largest standoff between a tubular string and the wellbore to be moved radially around within in a zone in the wellbore without having to employ any attached device which is moved axially in the well.

Another object of the present invention is to provide method and apparatus useful for causing the area of largest standoff between a tubular string and the wellbore to be moved circumferentially in the wellbore, thus making not just a few points, but every point along the circumference of the wellbore the large standoff area at some time. Furthermore, not just one depth zone but several can be selected for this special treatment.

Other aspects, objects, and advantages of the present invention will be apparent from the following disclosure taken in conjunction with the accompanying Figures.

SUMMARY OF THE INVENTION

In accordance with the present invention there is provided a method for manipulating a tubular string located within a wellbore or outer tubing comprising (1) employing a decentralizing means which independent of any axial movement of said tubular string or of any device attached to said tubular string will create an area of largest standoff in at least one zone along the length of said tubular string and (2) shifting the area of largest standoff at least partly around the circumference of the wellbore or outer tubing.

Also in accordance with the present invention there are provided devices which serve as decentralizers for such processes.

DETAILED DESCRIPTION OF THE INVENTION

Figure 1:
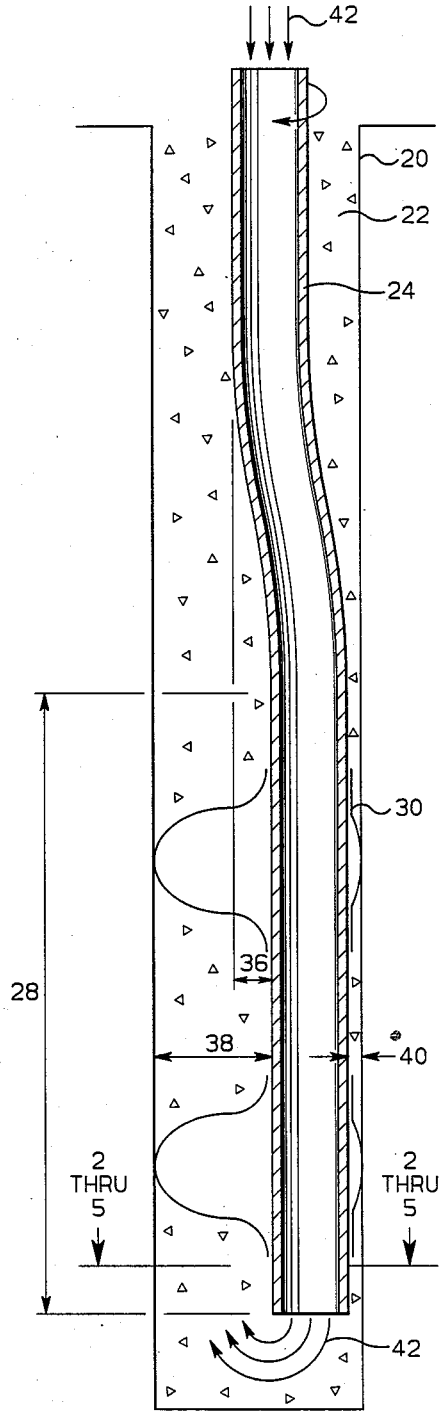
FIG. 1 is a diagramatical vertical cross-sectional view of a wellbore containing a tubing string having decentralizers in accordance with the present invention.

With reference to FIG. 1 there is illustrated a wellbore 20 that has been drilled in the earth. Within the wellbore there is located a tubular string 24 separated from the wellbore 20 by annulus 22. In a conventional operation well conditioning fluids and/or cement 42 is pumped through the tubular string and up through the annulus between the tubular string 24 and the walls of the wellbore 20. In the embodiment illustrated in FIG. 1 the tubular string 24 is forced offcenter in a zone 28 of the wellbore by decentralizers 30 attached in a fixed relationship to the tubing string 24. The decentralizers force the tubular string 20 off-center of the wellbore 20 a distance 36 referred to herein as the offset. The decentralizers result in an area of largest standoff 38 and an area of smallest standoff 40.

FIGS. 2 to 5 illustrate how the well conditioning fluids and/or cement 42 flows in the annulus 22 between the wellbore 20 and the tubular string 24 in the zone 28.

Figure 2:
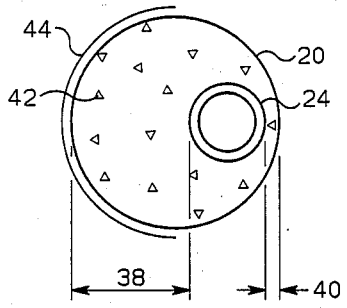
FIG. 2 is a horizontal cross-sectional view of a tubular string located off the center of the wellbore showing how in a conventional practice the area of largest standoff remains basically stationary so that there is not vigorous flow of fluid such as cement along certain areas of the wellbore.

FIG. 2 shows that before the tubing is rotated there is an area of minimum standoff 40 and an area of largest standoff 38. The fluid in the annulus is considered to flow more vigorously in the area of larger standoff than in the area of minimum standoff. When the tubular string is rotated in a conventional manner without using the decentralizers used in the present invention every point along the circumference of the tubular string is exposed to vigorously flowing cement for a time. However, the wellbore at the point of the smallest standoff is never exposed to vigorously flowing cement.

Figure 3:
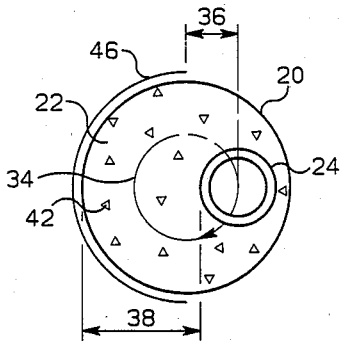
FIGS. 3 to 5 are horizontal cross-sectional views of the tubular string of FIG. 1 illustrating how the area of largest standof moves when the tubular string is manipulated in accordance with this invention.
Figure 4:
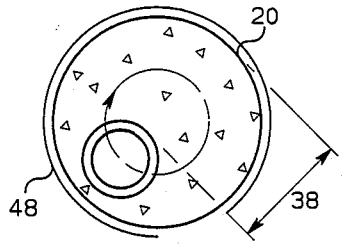
Figure 5:
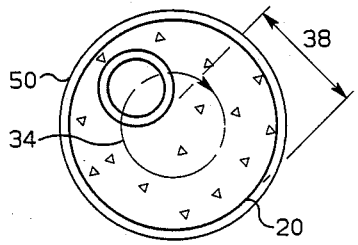

FIGS. 3 to 5 illustrate that when the tubular string is shifted in a circular path using the present invention the area of largest standoff 38 is also shifted completely around the circumference of the wellbore 20. In FIG. 3 the area of easiest fluid flow is in the arc 46. As the tubing is rotated this arc is increased to the arc 48, as shown in FIG. 4, and finally by the time the area of largest standoff has been shifted 360 degrees to the total circumference of the wellbore 50, as shown in FIG. 5.

The effectiveness of the present invention in cementing a tubular string in a formation is believed to be based at least in part on the following four concatenated phenomena: (1) Cement voids are more likely to occur along the wellbore 20 than along the tubular string 24, (2) Where the cement 42 sweeps the wellbore vigorously fewer cement voids occur, (3) Sweeping is more effective at higher cement velocities, and (4) The cement velocity is higher in the areas of largest standoff.

FIG. 1 shows a tubular string 24 which over at least one zone 28 is forced off the center of the wellbore 20 by de-centralizers 30 which are attached to the tubular string 24. When the tubular string 24 is rotated the area of largest standoff will be shifted around the circumference of the wellbore thus allowing the cement to flow vigorously at every point along the circumference of the wellbore 20 for a time. This is in contrast to the conventional prior art rotation of a tubular string where every point along the tubular string will be exposed to vigorous flow but only a few points along the circumference of the wellbore will be exposed to vigorous flowing cement.

Figure 6:
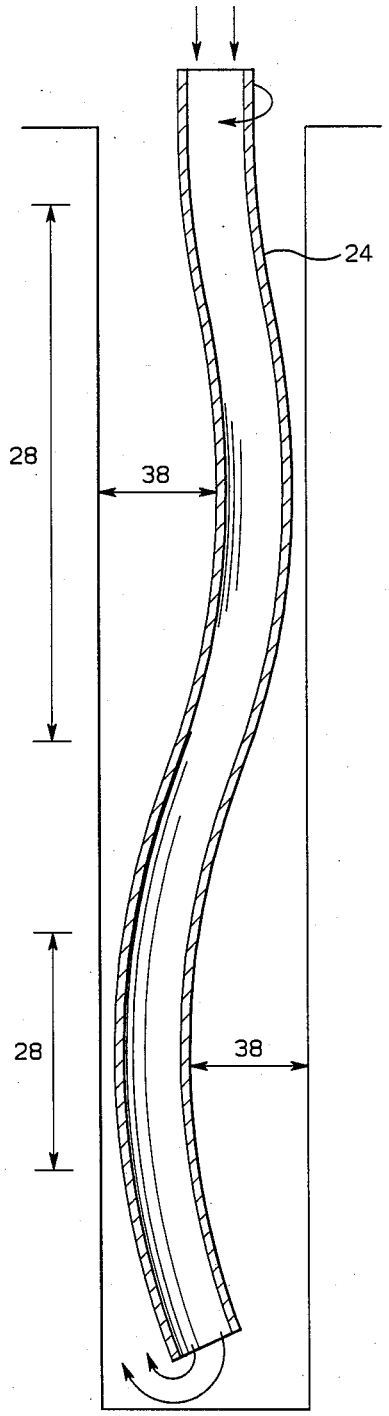
FIG. 6 is a diagramatical vertical cross-section of a wellbore employing a non-straight, i.e. non-linear, section of tubular string to provide decentralization.

FIG. 6 illustrates another method for forcing a tubular string offcenter in a given zone so that at least a portion of the tubular string can be moved in an orbital path around the center of the wellbore. In this embodiment of the invention an area of large standoff 38 is provided by the use of tubular string having a non-straight section where an offset is desired. This provides large standoff areas 38 within the height intervals 28. Rotation of the tubular string causes the center of the tubing at the desired height level to follow an orbital path relative to the center of the wellbore.

Figure 7:
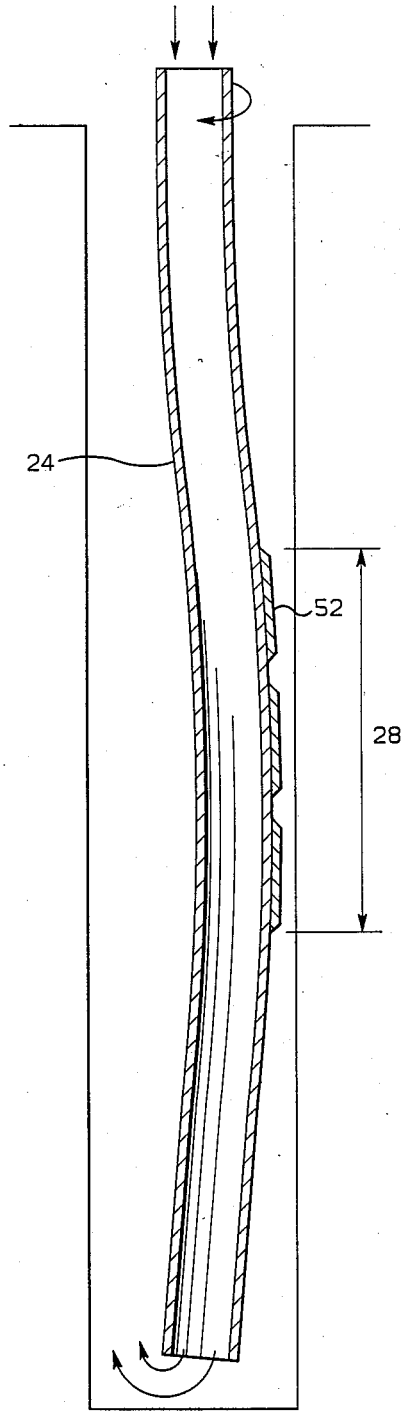
FIG. 7 is a diagramatical vertical cross-section of a wellbore showing a tubular string containing weights on one side thereof which causes decentralization as the tubing is rotated.

Still another method of forcing the large standoff of a tubular string along such an orbital path is shown in FIG. 7 wherein weights 52 are attached to one side of the tubular string 24 over at least one height interval 28. Rotation of the tubular string generates centrifugal forces which cause at least part of the tubular string to follow an orbital path. Preferably the weights have bevelled edges as illustrated so as to minimize undesired scraping of the wellbore.

Figure 8:
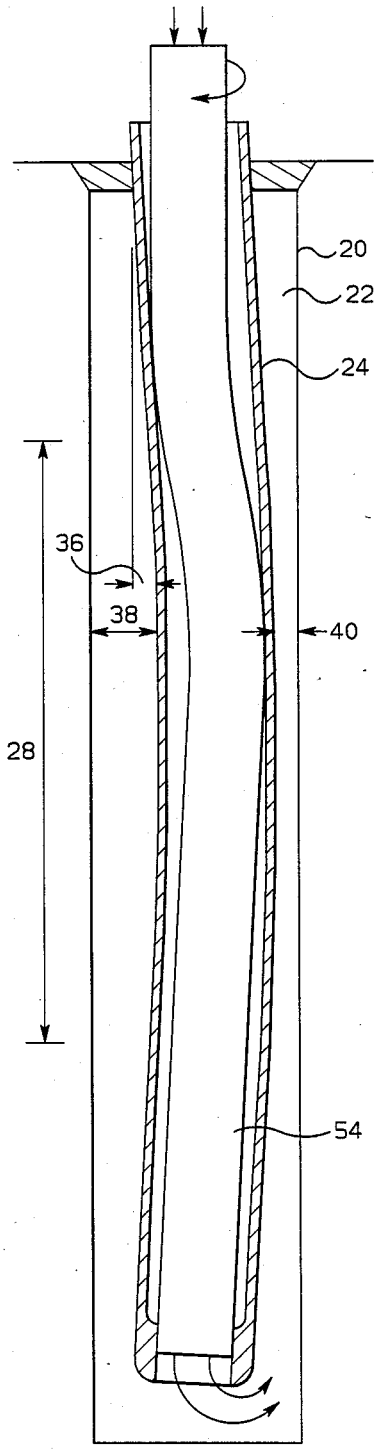
FIG. 8 is a diagramatical vertical cross-section of a wellbore showing the use of a non-straight stab-in string to cause decentralization of a surrounding tubular string.

Yet another method in accordance with the present invention is illustrated in FIG. 8. In this embodiment the wellbore 20 surrounds the tubular string 24, and a stab-in string 54 is located inside the tubular string 24. Well conditioning fluids and/or cement are pumped through the stab-in string 54 and into the annulus 22 between the tubular string or casing 24 and the wellbore 20. The stab-in string 54, in this embodiment is a string of tubing that is sufficiently non-straight in at least one section prior to being inserted into the tubing string 24 that when it is so inserted it causes the tubing string 24 to be rendered non-linear over at least one height interval 28. Rotation of the stab-in string 54, the tubing string 24, or both simultaneously causes the center of the tubular string 24 in the height interval 28 to follow the orbital path.

Figure 9:
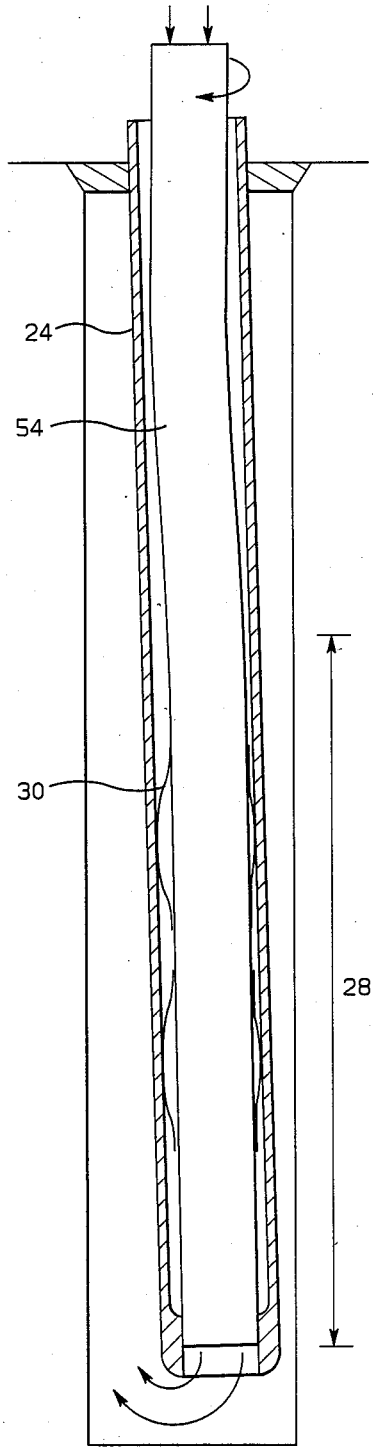
FIG. 9 is a diagramatical vertical cross-section of a wellbore showing the use of a decentralizer to decentralize a stab-in string of tubing which in turn decentralizes the surrounding tubular string.

A similar embodiment is disclosed in FIG. 9 wherein the stab-in string 54 is forced off the center of the tubular string by means of decentralizers 30 attached to the stab-in string 54. The stab-in string will thus be imbalanced and when rotated will generate centrifugal forces which cause at least part of the tubular string in interval 28 to follow an orbital path.

Figure 10:
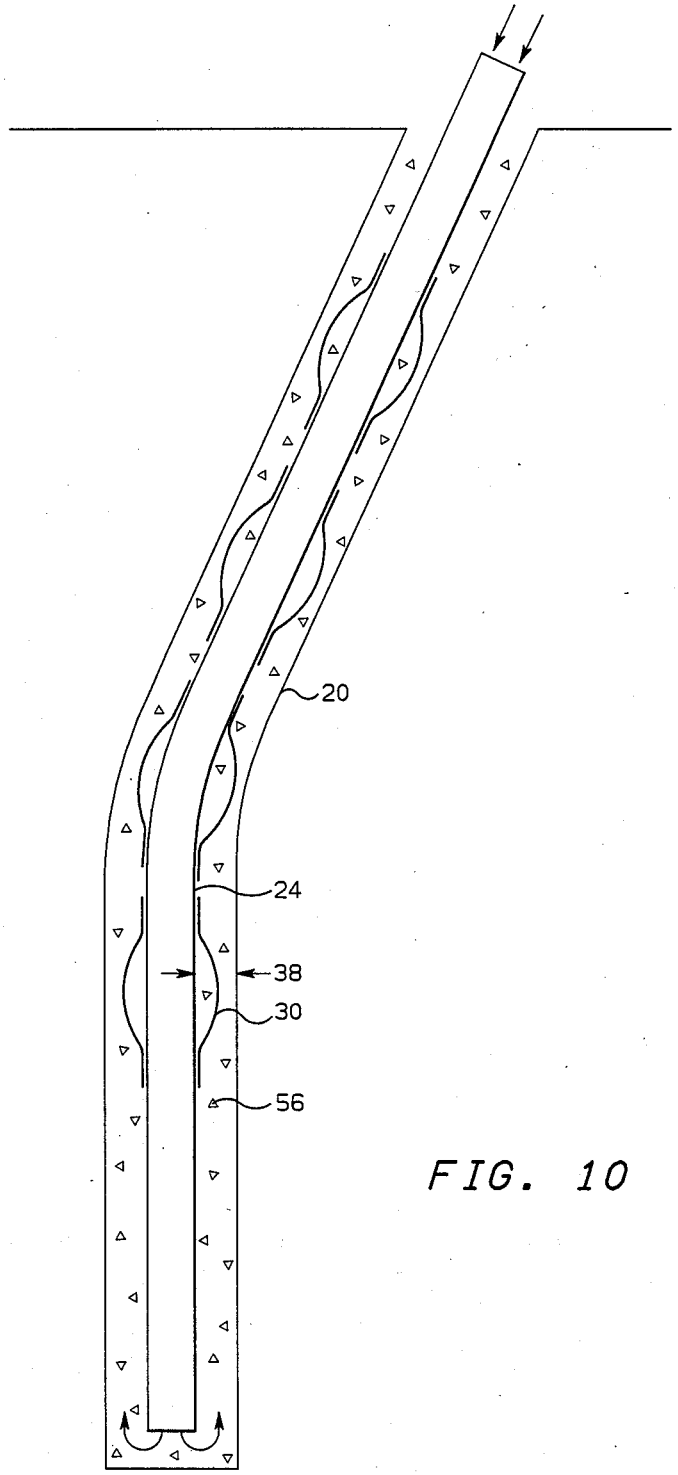
FIG. 10 is a diagrammatical vertical cross section of a deviated wellbore containing a tubular string having decentralizers in accordance with the present invention.

FIG. 10 illustrates the application of the present invention to a situation wherein the tubular string is located in a deviated borehole. In this case the decentralizers assist in preventing the tubing 24 from resting on the wall of the wellbore 20. It should also be apparent that using a series of the decentralizers can provide the additional benefit of allowing one to guide the tubing around deviations in the wellbore by rotating the tubing to increase or decrease the standoff in a given area as might be needed. Once the tubing has been placed at the desired level then the decentralizers can assure that the standoff can be shifted during the application of cement to the annulus between the tubing and the wellbore.

Figure 11:
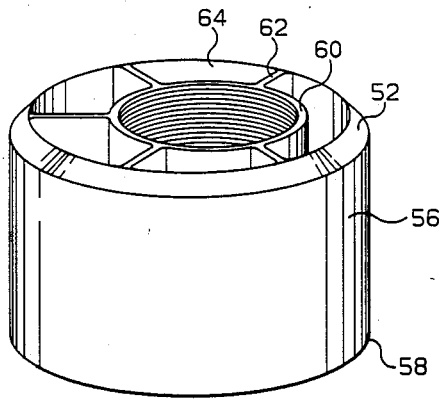
FIG. 11 is a perspective view of one embodiment of an inventive positive standoff type decentralizer.

FIG. 11 shows one embodiment of a positive standoff de-centralizer. The decentralizer comprises an substantially circular outer shell portion 56 which has rounded edges 58 and preferably a substantially smooth periphery to avoid gouging of the wellbore. The shell portion 56 surrounds a central portion 60 eccentrically. The central portion 60 is constructed in basically the same manner as a conventional pipe collar. Ribs 62 tie the shell 56 to the central portion 60 in a fixed relationship. The ribs are spaced apart so that there are voids 64 between them to permit cement or other fluids to flow past the decentralizer. The size of the decentralizers can vary widely; however, generally it is desirable for the largest outside dimension of the decentralizer to be 1 to 6 inches less than the inside diameter of the wellbore, still more preferably 1 to 3 inches less. While the embodiment illustrated employs a shell that is circular, it is within the scope of the invention to use shells that are more elliptical in shape.

Figure 12:
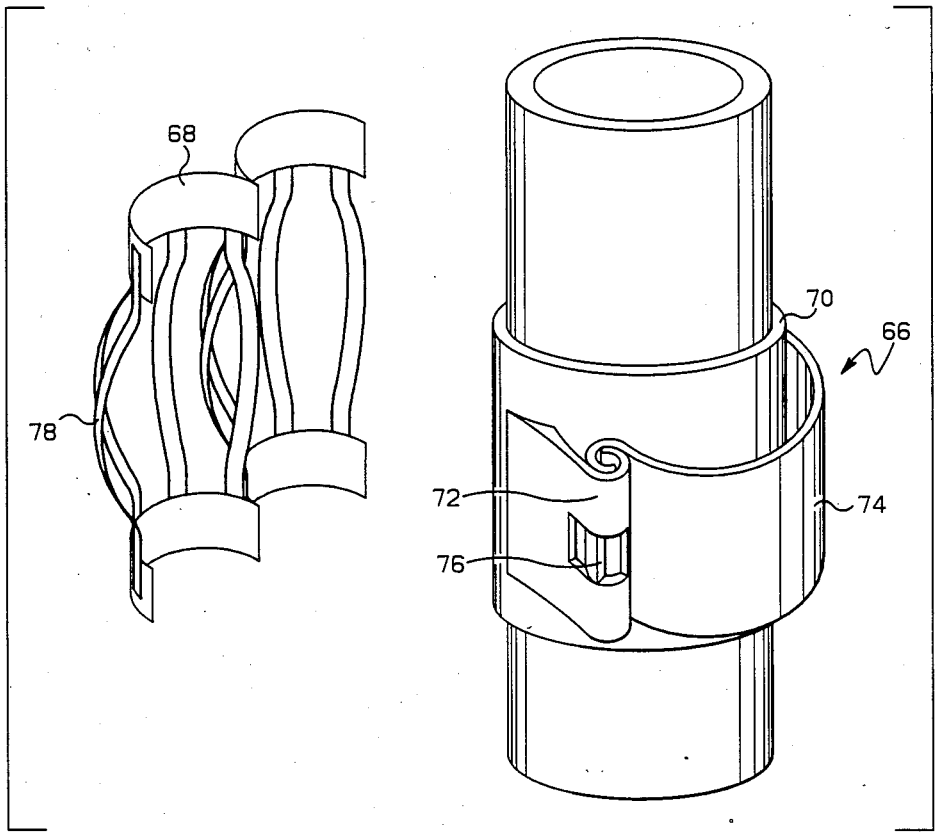
FIG. 12 is an exploded perspective view of another inventive decentralizer.

FIG. 12 shows another device of the present invention that is capable of serving as a de-centralizer. In this case a spring plate 74 is hooked to a hinge 72 and secured thereto by tab 76. The hinge in turn is secured to a conventional pipe collar 70 which is attached to two sections of the tubular string. The hinge 72 and the spring plate 74 have a smooth outer surface and rounded edges to avoid catching on surrounding parts when the collar 70 is rotated or moved axially. The spring plate 74 is a curved plate which extends outwardly only around one side of the collar 70.

In a preferred embodiment this spring plate 74 is employed in conjunction with a conventional centralizer of a suitable size. When a centralizer 68 is installed around the inventive booster device 66, the spring plate 74 pushes some of th spring leaves 78 of the centralizer 68 outward, making the circumference of the centralizer 68 eccentric to the collar 70. The resulting combination thus converts the centralizer 68 into a decentralizer. In the wellbore, the spring leaves 78 of the centralizer 68 and the spring plate 74 flex to accomodate wellbore diameter variations. When the pipe string is rotated the centralizer 68 remains non-rotating relative to the pipe and thus will serve to cause the standoff to be shifted completely around the circumference of the wellbore in the zone of the decentralizer as the pipe string is rotated.

While the present invention has now been described in some detail in regard to particular preferred embodiments, it should be clear that there are other and further modifications apart from those shown and described herein which will be obvious from the foregoing disclosure which may be made without departing from the spirit and scope of the claimed invention and its equivalents.

What is claimed is:

1. A decentralizer comprising a pipe collar adapted to connect two sections of pipe in axial alignment, an outer shell of generally circular cross-section surrounding said pipe collar in a completely spaced apart eccentric relationship to said pipe collar, and a plurality of spaced apart connecting means extending inwardly from the inside wall of said outer shell to the pipe collar in such a manner as to secure said outer shell to said pipe collar.

2. A decentralizer adapted to cause a section of a tubular string to be forced off-center relative to a surrounding annulus, said decentralizer comprising an outer shell of generally circular cross-section adapted to be fixed around said tubular string, a plurality of connecting means extending inwardly from circumferentially spaced apart locations on the inside wall of said outer shell in such a manner as to secure said outer shell around said tubular string in a completely spaced apart off-center relationship to said tubular string, said outer shell having dimensions such that opposite sides of said outer shell can engage opposite sides of said surrounding annulus.

3. A decentralizer according to claim 2 wherein said outer shell is attached to a pipe collar adapted to connect two sections of tubing in axial alignment to form said tubular string.

4. A method for cementing a tubular casing in a wellbore comprising (1) inserting said casing string in said well bore, (2) causing a section of the casing to be out of alignment with a portion of said casing and off-center relative to said wellbore independent of any axial movement of said casing or of any axial movement of any device attached to said casing to create an area of largest standoff, and (3) shifting said area of largest standoff at least partly around the circumference of the wellbore while pumping cement into the annulus between the wellbore and the casing wherein said section of said casing is forced off-center as a result of the employment of a casing having a section that is rendered non-straight by having contained therein a stab-in string containing a non-straight section which forces a section of the casing to become non-straight.

5. A method according to claim 4 wherein said area of largest standoff is shifted as a result of rotation of said casing about the axis of said casing.

6. A method according to claim 5 wherein said cement is pumped downwardly within said casing and then upwardly through the annulus between the casing and the wellbore.

7. A method according to claim 6 wherein said area of largest standoff is shifted completely around the circumference of the wellbore while said cement is pumped upwardly through said annulus.

8. A method for cementing a tubular casing in a wellbore comprising (1) inserting said casing string in said well bore, (2) causing a section of the casing to be out of alignment with a portion of said casing and off-center relative to said wellbore independent of any axial movement of said casing or any axial movement of any device attached to said casing to create an area of largest standoff, and (3) shifting said area of largest standoff at least partly around the circumference of the wellbore while pumping cement into the annulus between the wellbore and the casing wherein a section of said casing has weights located on only one side of said casing, said weights having dimensions such that when the casing is rotated the centrifugal force of the weights will force a section of said casing off-center to create said area of largest standoff and wherein said area of largest standoff is shifted as a result of rotation of said casing about the axis of said casing.

9. A method according to claim 4 wherein said area of largest standoff is shifted as a result of the rotation of said stab-in string about its own axis within said casing.

10. A method according to claim 4 wherein said stab-in string is rendered non-straight as a result of the presence of at least one decentralizer located on the stab-in string which through contact with the interior of the casing forces the stab-in string non-straight.

11. A method for cementing a tubular casing in a wellbore comprising (1) inserting said casing string in said well bore, (2) causing a section of the casing to be out of alignment with a portion of said casing and off-center relative to said wellbore independent of any axial movement of said casing or of any axial movement of any device attached to said casing to create an area of largest standoff, and (3) shifting said area of largest standoff at least partly around the circumference of the wellbore while pumping cement into the annulus between the wellbore and the casing wherein said casing is caused to be off-center as a result of at least one decentralizer secured around a section of the casing, said decentralizer having dimensions sufficient to contact the wall of said well bore and force the casing off-center relative to said well bore, said at least one decentralizer further having at least one axial opening which will allow cement to flow past said decentralizer and wherein said area of largest standoff is shifted as a result of rotation of said casing about the axis of said casing.

12. A method according to claim 11 wherein said at least one decentralizer comprises an outer shell of generally circular crosssection fixed around said casing in a spaced apart relationship, a plurality of spaced apart connecting means extending inwardly from the inside wall of said outer shell in such a manner as to secure said outer shell to said casing in a spaced apart off-center relationship to said casing, said outer shell having dimensions such that opposite sides of said outer shell can engage opposite sides of said surrounding well bore annulus.

13. A method according to claim 12 wherein said cement is pumped downwardly within said casing and then upwardly through the annulus between the casing and the wellbore.

14. A method according to claim 11 wherein said casing is caused to be off-center as a result of at least one decentralizer comprising a curved spring plate having two ends and a central portion, wherein said two ends are spaced apart so as to fit at spaced apart locations around the circumference of said casing and wherein said central portion is dimensioned such that it will be completely spaced apart from the circumference of said casing a sufficient distance to assure that when said decentralizer is attached to said casing the outer surface of said central portion of said curved spring plate will contact the wall of said well bore annulus and force said casing off-center relative to said annulus.

15. A method according to claim 12 wherein the area of largest standoff is shifted completely around the circumference of the well bore while said cement is pumped upwardly through said well bore.

16. A method for cementing a tubular casing in a wellbore comprising (1) inserting said casing string in said well bore, (2) causing a section of the casing to be out of alignment with a portion of said casing and off-center relative to said wellbore independent of any axial movement of said casing or of any axial movement of any device attached to said casing to create an area of largest standoff, and (3) shifting said area of largest standoff at least partly around the circumference of the wellbore while pumping cement into the annulus between the wellbore and the casing wherein said casing is caused to be off-center as a result of at least one decentralizer secured around a section of said casing, said decentralizer comprising the combination of a first device comprising upper and lower rings surrounding said casing at spaced apart locations and a plurality of spaced apart outwardly flexed spring leaves connecting said upper and lower rings and a second device comprising a curved spring plate having two ends and a central portion, said second device being secured to said casing between the upper and lower rings of said first device, the two ends of said spring plate being spaced apart so as to fit at spaced apart locations around the circumference of said tubular string and the central portion of said plate being dimensioned such that said central portion will be spaced completely apart from said casing and such that said second device will force at least some of the spring leaves of said first device outwardly a sufficient distance that said combination forces said casing to be off-center and wherein said area of largest standoff is shifted as a result of rotation of said casing about the axis of said casing.

* * * * *